US005907268A

United States Patent [19]

Mader

[11] Patent Number: 5,907,268

[45] Date of Patent: May 25, 1999

[54] ELECTROMAGNETIC RELAY

[75] Inventor: Leopold Mader, Moedling, Austria

[73] Assignee: EH-Schrack Components AG, Wien, Austria

[21] Appl. No.: 09/108,861

[22] Filed: Jul. 1, 1998

[30] Foreign Application Priority Data

Jul. 1, 1997 [DE] Germany ..... 197 27 991

[51] Int. Cl.[6] ..... H01H 9/02

[52] U.S. Cl. ..... 335/202; 335/130; 335/133

[58] Field of Search ..... 335/78–86, 124, 335/128–132, 133, 134, 135, 97, 98, 202, 88–89, 107

[56] References Cited

U.S. PATENT DOCUMENTS 3,800,250 3/1974 Mori et al. ..... 335/128

4,761,627 8/1988 Bell ..... 335/128

5,204,647 4/1993 Nagamoto et al. ..... 335/80

*Primary Examiner*—Lincoln Donovan

*Attorney, Agent, or Firm*—Hill & Simpson

[57] ABSTRACT

A relay is provided with fixed contact mounts anchored in a base, as well as contact springs arranged between the fixed contact mounts. The springs are actuated at their free ends. The contact springs each have spring mounts that include terminal segments anchored in the base, respectively parallel to the fixed contact mounts, but outside the space enclosed by them. These terminal segments are connected with the appertaining contact springs via U-shaped connection segments; the connection segments are guided in corresponding guide channels of the base in an insulated fashion. In this way, several sets of switchover contacts can be arranged in simple and space-saving fashion in a relay base, given a predetermined terminal configuration.

18 Claims, 3 Drawing Sheets

ELECTROMAGNETIC RELAY

BACKGROUND OF THE INVENTION

1. Field of the Invention

The present invention relates to an electromagnetic relay. More specifically, the present invention relates to an electromagnetic relay having a base that defines a base plane. The relay includes at least one switchover contact set including two fixed contact mounts anchored in parallel in the base and fixed contacts on their free ends. Each contact set also having a contact spring that can be switched over between the fixed contacts at a first end which bears a movable contact and a second end which is fastened to a spring mount that comprises a terminal segment that is anchored in the base parallel to and in alignment with the fixed contact mounts, but outside the space enclosed by them. The relay also has an electromagnet system that stands with its coil axis vertical with respect to the base and whose armature movement is transmitted to the contact spring(s) via a slide that can be moved parallel to the base plane.

A relay of the above-described variety is known for example from DE-AS 1 166 893. There, the spring mounts project upward from the base approximately parallel to the coil axis, and the contact spring is respectively fastened on its upper end, said spring extending in the opposite direction and working together with the fixed contacts in the base region. In this case, the bolt engages with the contact spring between the fastening point and the contacts, by which means the effective spring length is limited and the forces to be applied by the magnet system are relatively high.

From EP 0 016 980 B1, a relay for high switching capacity is known in which a spring mount is arranged between two fixed contact mounts, whereby the spring extends upward from the base, parallel to the contact mount. The terminal pins of the fixed contact mounts are disposed on the external side of the base and are bent at right angles, in order to produce a greater distance to the spring mount.

There is a need for a relay of the type cited above, having a simplified construction and which can be used in an arrangement with several switchover contacts, with spring mounts that lie with their terminals in a predetermined grid outside the fixed contact mounts, but with the contact springs arranged in an easily surveyed fashion between the fixed contacts, and which can be actuated by the magnet system in such a way that their circuit state can also be easily monitored.

SUMMARY OF THE INVENTION

According to the relay of the present invention, this aim is achieved in that each spring mount comprises a U-shaped connection segment that runs from a terminal segment into a region between both the fixed contact mounts and in an upwardly open guide channel of the base. The relay of the present invention includes a contact spring that is fastened to a connection segment disposed in the region of the guide channel. The contact spring extends upward perpendicular to the base plane from the base, and engages with a slide in a region of the upper side of the relay, opposite the base.

With the inventive U-shaped connection segment of the fixed contact mount, it is thus possible to achieve a simple and well-insulated supply of current to the respective contact spring, given a predetermined terminal configuration, whereby this arrangement permits a space-saving arrangement of switchover contact sets in a base made of insulating material.

Since the movable ends of the contact springs with the slide are located opposite the base on the upper side of the relay, a good monitoring of the circuit state is also possible, e.g. through a window in a housing cover. The connection of the contact spring(s) with the slide is provided via a respective actuating tab, bent into a hook shape, at the free end of each contact spring. The tab engages in a recess of the slide. In addition, the slide is usefully supported by shoulders of the contact springs, which are respectively provided adjacent to the actuating tabs. In addition, the slide is usefully fastened in recesses of the armature, by means of snap hooks.

In a preferred construction, the base of the relay comprises a honeycomb-type arrangement with upwardly standing insulating walls, which respectively delimit the guide channels for the connection segments, as well as the plug channels for the fixed contact mounts. The plug channels are insulated from the guide channels, and from one another. The fixed contact mounts for the break contacts, on the one hand, and the make contacts, on the other hand, are preferably of the same construction, and are set so as to be rotated relative to one another by only 180°.

In a construction of the invention, the electromagnet system has a coil with an axis that stands perpendicular to the base plane, an essentially L-shaped core that extends with its long arm through the coil, and an essentially L-shaped armature whose short arm is mounted on the free end of the long core arm so as to be able to be rolled away, and which actuates the contact springs with the free end of the long armature arm, via the slide.

In an embodiment, the present invention provides an electromagnetic relay which comprises a base defining a base plane. The base is connected to at least one switchover contact set. The base further comprises at least one guide channel. The switchover contact set comprises a make contact mount and a break contact mount. The make and break contact mounts are disposed parallel to one another and in alignment. Both the make and break contact mounts are connected to the base. The make contact mount further includes a make contact disposed at a free end thereof. Similarly, the break contact mount includes a break contact disposed at a free end thereof.

The switchover contact set further comprises a contact spring disposed between the make contact mount and the break contact mount. The spring comprises a first end which includes a movable contact disposed between the make contact and the break contact. The spring further comprises a second end that is connected to a spring mount. The spring mount comprises a terminal segment that is connected to the base and a U-shaped connection segment that connects the terminal segment to the second end of the spring. The terminal segment is disposed parallel to, in alignment with, but spaced apart from the make contact mount and the break contact mount. The U-shaped connection segment is accommodated in the guide channel of the base. The contact spring extends from the guide channel and perpendicular to the base plane to a slide which is connected to the armature of the electromagnet system. The slide is disposed opposite the base with the spring disposed therebetween.

In an embodiment, the slide further comprises an opening and the spring further comprises a hook-shaped actuating tab disposed at the free end thereof for engaging the opening of the slide.

In an embodiment, the spring further comprises broadened shoulders disposed adjacent to the actuating tab for supporting the slide.

In an embodiment, the armature further comprises an opening and the slide further comprises a resilient snap hook for engaging the opening of the armature.

In an embodiment, the base comprises a honeycomb-type structure of upwardly standing insulating walls which define the guide channel for accommodating the connection segment as well as plug channels for accommodating the make contact mount and the break contact mount. The plug channels are insulated from the guide channel and from one another.

In an embodiment, the make contact mount and the break contact mount are of identical construction and are anchored to the base in plug channels disposed in the base in an aligned and opposing relationship to one another.

In an embodiment, the electromagnet system further comprises a coil with an axis that extends perpendicular to the base plane. The electromagnet system further comprises an L-shaped core comprising a long core arm and a short yoke arm. The long core arm extending through the coil and perpendicularly away from the base plane.

In an embodiment, the armature is L-shaped and comprises a long arm and a short arm. The short arm of the armature is mounted for pivotal contact against the long core arm. The long arm of the armature is also connected to the slide.

In an embodiment, the short yoke arm comprises a pole segment that is bent parallel to coil axis. The pole segment forms an operational air gap with the long arm of the armature.

In an embodiment, the electromagnet system further comprises a coil body. The coil body comprises a pocket for accommodating the short arm of the armature. The short arm of the armature is biased against the long core arm by an armature spring.

It is therefore an advantage of the present invention to provide a plurality of switchover contact sets arranged on a single base in a simple and space-saving fashion.

Other objects and advantages of the invention will become apparent upon reading the following detailed description and appended claims, and upon reference to the accompanying drawings.

BRIEF DESCRIPTION OF THE DRAWING

The invention is explained below in more detail in relation to an exemplary embodiment on the basis of the drawing, wherein.

Figure 1:
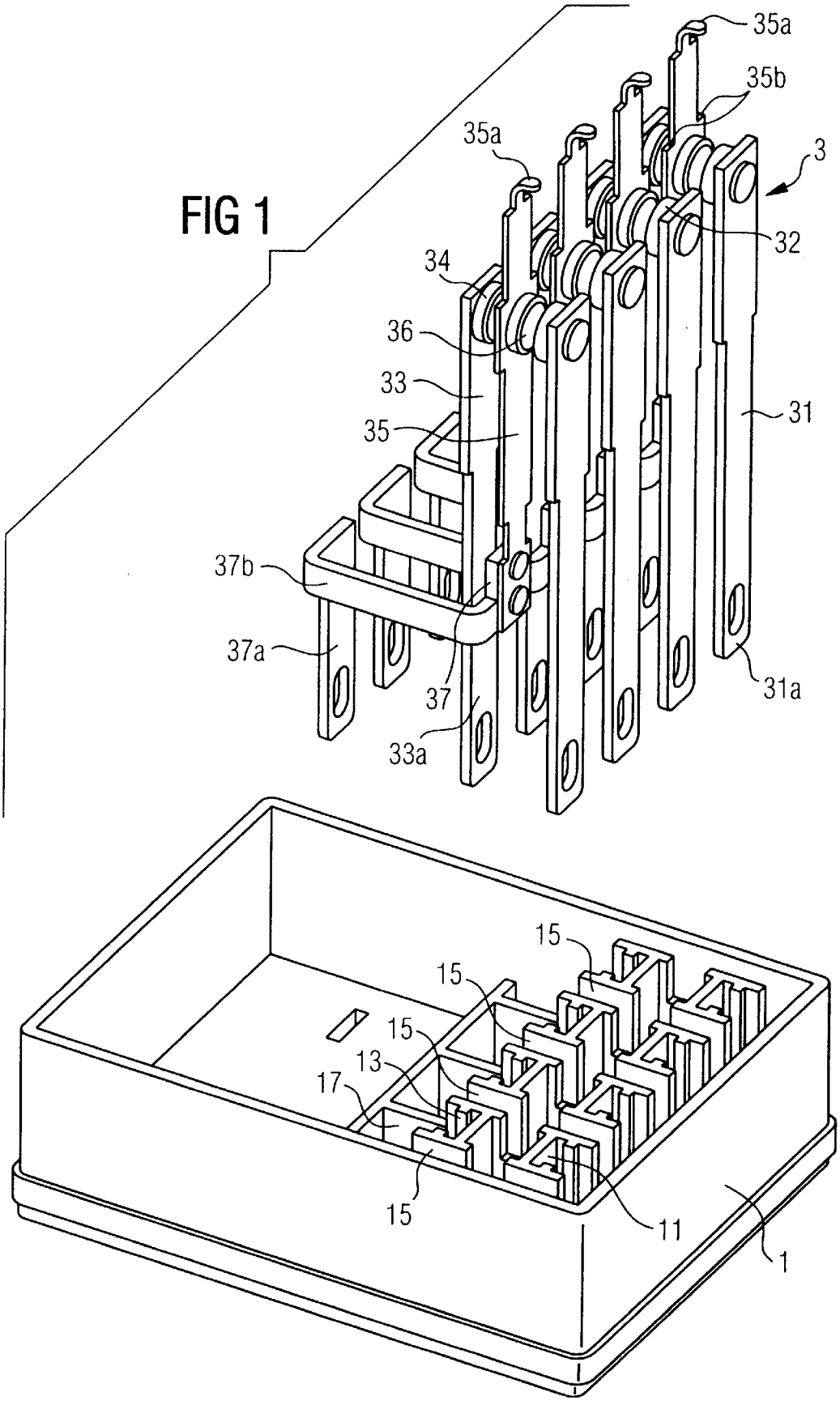
FIG. 1 illustrates a relay base made in accordance with the present invention, particularly illustrating four switchover contact sets in assembly arrangement.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

The relay in FIGS. 1 to 4 include a housing with a base 1 and a cover 2, in which four switchover contact sets 3 and one magnet system 4 are arranged.

Each switchover contact set 3 has two fixed contact mounts, namely a break contact mount 31 with a break contact 32, and a make contact mount 33 with a make contact 34. A contact spring 35 with a movable contact 36 is arranged between the two. This contact spring 35 is held by a spring mount 37, which like the two fixed contacts mounts is anchored in the base 1. For this purpose, the fixed contact mounts each have terminal pins 31*a* or, respectively, 33*a*, while the spring mount 37 forms a terminal pin 37*a*. For the plug fastening of the fixed contact mounts, appertaining plug channels 11 and 13 are respectively provided in the base; in addition, a plugging channel 17 is respectively provided for the fastening of the spring mount; the plug channels 11, 13 and 17 are separated from one another by insulating walls 16.

Since according to a predetermined terminal configuration the terminal pins 37*a* for the contact spring are not supposed to lie between the terminals 31*a* and 33*a* of the fixed contacts, but rather outside them at a certain distance, each spring mount 37 has a U-shaped connection segment 37*b*, which, insulated in a corresponding guide channel 15 of the base, leads to the contact spring 35. The contact spring 35 is connected to the spring mount 37, e.g. by riveting or welding. In addition, each contact spring has at its free end a hook-shaped actuating tab 35*a*, and, at a certain distance therefrom, lateral shoulders 35*b* for connection to a slide 5, which transmits the switching motions of the magnet system 4 to the contact springs 35.

The magnet system 4 essentially consists of a coil 41 with a coil body 42, an essentially L-shaped core 43 and an essentially L-shaped armature 44. The core 43 is guided through the coil with its long core arm 43*a*, so that at its free end the armature 44 is mounted with its short arm 44*b* so as to be able to be rolled away. The long arm 44*a* of the armature 44 in turn forms an operating air gap with the short yoke arm 43*b* of the core, or, respectively, with a pole segment 43*c*, which is fashioned as an extension of the short core arm 43*b* and is bent off parallel to the coil axis. The armature is guided with its short arm 44*b* in a pocket 42*a* of the coil body 42. It is held in its mount by an armature spring 45.

The slide 5 is plugged onto the free end of the armature arm 44*a* with a mouth-type opening 51, so that the slide is connected in the manner of a joint with this arm, and can be actuated in its longitudinal direction. In addition, the slide 5 respectively comprises openings 52 in which the respective contact springs 35 engage with their actuating tabs 35*a*. In addition, the slide 5 rests with its underside on the shoulders 35*b* of the contact springs. The slide 5 is fastened at its other end in openings of the armature, with snap projections 54.

Figure 2:
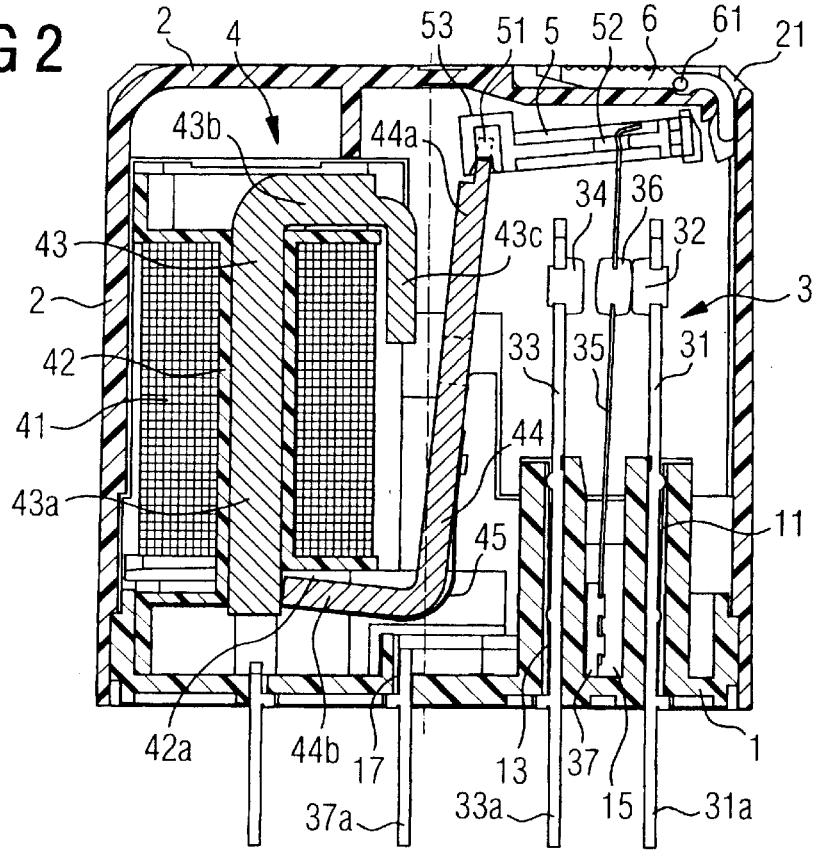
FIG. 2 is a longitudinal sectional view of a relay made in accordance with the present invention.
Figure 3:
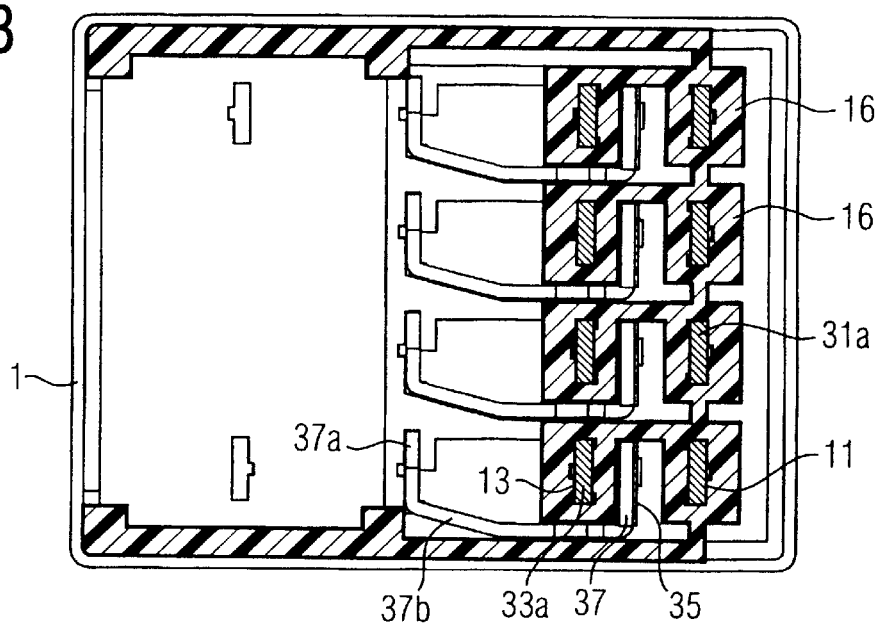
FIG. 3 is a cross-sectional view of the relay shown in FIG. 2, taken substantially along line III—III, which is parallel to the base plane, through the base of the relay as shown in FIG. 2 (without the magnet system)
Figure 4:
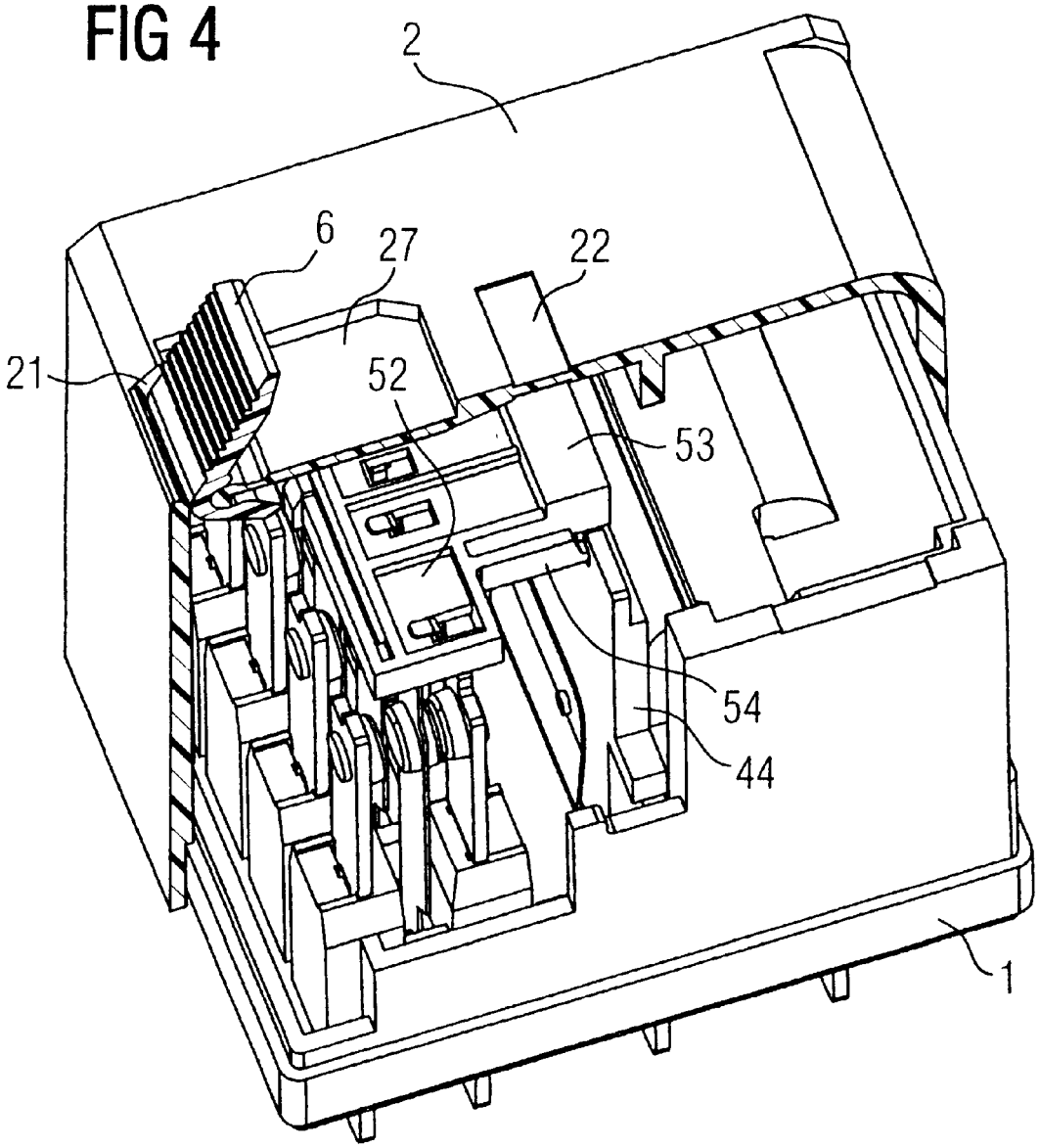
FIG. 4 is a perspective view of the relay as shown in FIG. 2, with a partially cut-away cover.

As can also be seen in FIGS. 2 and 4, a pivoting lever 6 is arranged in the cover 2 in a recess 21, which lever can be pivoted by hand about a rotational axle 61. In this way, the slide 5 can be actuated by hand via this pivoting lever 6, and can also be stopped if warranted. Via a window 22 in the cover, the position of the slide 5 can thereby be monitored; the slide has an indicating surface 53 for this purpose.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. An electromagnetic relay comprising:

at least one switchover contact set mounted to a base defining a base plane, the switchover contact set comprising a make contact mount and a break contact mount disposed parallel to one another and connected to the base, the make contact mount including a make contact disposed at a free end thereof, the break contact mount comprising a break contact disposed at a free end thereof, the switchover contact set further comprising a contact spring disposed between the make contact mount and the break contact mount, the spring comprising a first end comprising a movable contact disposed between the make contact and the break contact, the contact spring further comprising a second end connected to a spring mount, the relay further comprising an electromagnet system comprising an armature connected to the contact spring by a slide that is disposed parallel to the base plane, the spring mount comprising a terminal segment connected to the base and a U-shaped connection segment comprising a first leg connected to the terminal segment and a second leg connected to the second end of the spring, the make contact mount being disposed between the terminal segment and the second end of the spring with the U-shaped connection segment extending around the make contact mount, the terminal segment being disposed parallel to, in alignment with, but spaced apart from the make contact mount, the break contact mount and the second end of the spring, the U-shaped connection segment further being accommodated in the guide channel of the base, the contact spring extending from the guide channel and perpendicular to the base plane to the slide which is disposed opposite the base, the base comprising a unitary molded honeycomb-type structure of upwardly standing insulating walls which define the guide channel for accommodating the connection segment as well as plug channels for accommodating the make contact mount and the break contact mount, the plug channels being insulated from the guide channel and from one another, the plug channels being disposed in the base in an aligned and opposing relationship to one another.

2. The relay of claim 1 wherein the slide further comprises an opening and the spring further comprises a hook-shaped actuating tab disposed at the free end thereof for engaging the opening of the slide.

3. The relay of claim 2 wherein the spring further comprises broadened shoulders disposed adjacent to the actuating tab for the supporting the slide.

4. The relay of claim 1 wherein the armature comprises an opening and the slide further comprises a resilient snap hook for engaging the opening of the armature.

5. The relay of claim 1 wherein the electromagnet system further comprises a coil with an axis that extends perpendicular to the base plane, the electromagnet system further comprising an L-shaped core comprising a long core arm and a short yoke arm, the long core arm extending through the coil and perpendicularly away from the base plane.

6. The relay of claim 5 wherein the armature is L-shaped and comprises a long arm and a short arm, the short arm of the armature being is mounted for pivotal contact against the long core arm, the long arm of the armature being connected to the slide.

7. The relay of claim 6 wherein the short yoke arm comprises a pole segment that is bent parallel to the coil axis, the pole segment forming an operational air gap with the long arm of the armature.

8. The relay of claim 7 wherein the electromagnet system further comprises a coil body, the coil body comprising a pocket for accommodating the short arm of the armature, the short arm of the armature being biased against the long core arm by an armature spring.

9. An electromagnetic relay comprising:

a plurality of switchover contact sets, each of which are mounted to a base defining a base plane, the base further comprising a unitary molded honeycomb-type structure of upwardly extending insulating walls which define a plurality of guide channels as well as a plurality of plug channels, each of said switchover contact sets comprising a make contact mount and a break contact mount disposed parallel to one another and connected to the base, each make contact mount including a make contact disposed at a free end thereof, each break contact mount comprising a break contact disposed at a free end thereof, each make contact mount being connected to the base at one of the plug channels, each break contact mount being connected to the base at one of the plug channels, the make and break contact mounts of each switchover contact set being connected to the base in a spaced-apart and aligned relationship, each of said switchover contact sets further comprising a contact spring disposed between the make contact mount and break contact mount of said set and a spring mount, each spring comprising a first end comprising a movable contact disposed between its respective make contact and break contact, each contact spring further comprising a second end connected to the spring mount of said set, the relay further comprising an electromagnet system comprising an armature connected to the contact spring by a slide that is disposed parallel to the base plane, each spring mount comprising a terminal segment connected to the base and a U-shaped connection segment comprising a first leg connected to the terminal segment and a second leg connected to the second end of its respective spring, each terminal segment being disposed parallel to, in alignment with, but spaced apart from its respective make contact mount, break contact mount and second end of its respective spring with its respective make contact mount disposed between said terminal segment and the second end of its respective spring, each U-shaped connection segment further being accommodated in one of the guide channels of the base and extending around its respective make contact mount, each contact spring extending from its respective guide channel and perpendicular to the base plane to the slide which is disposed opposite the base, each plug channel being insulated from each guide channel and from one another.

10. The relay of claim 9 wherein the slide further comprises a plurality of openings and each of said springs further comprising a hook-shaped actuating tab disposed at the free end thereof for engaging one of the openings of the slide.

11. The relay of claim 10 wherein each of said springs further comprises broadened shoulders disposed adjacent to the actuating tab for the supporting the slide.

12. The relay of claim 9 wherein the armature comprises an opening and the slide further comprises a resilient snap hook for engaging the opening of the armature.

13. The relay of claim 9 wherein each of said make contact mounts and each of said break contact mounts are of identical construction.

14. The relay of claim 9 wherein the electromagnet system further comprises a coil with an axis that extends perpendicular to the base plane, the electromagnet system further comprising an L-shaped core comprising a long core arm and a short yoke arm, the long core arm extending through the coil and perpendicularly away from the base plane.

15. The relay of claim 14 wherein the armature is L-shaped and comprises a long arm and a short arm, the short arm of the armature being is mounted for pivotal contact against the long core arm, the long arm of the armature being connected to the slide.

16. The relay of claim 15 wherein the short yoke arm comprises a pole segment that is bent parallel to the coil axis, the pole segment forming an operational air gap with the long arm of the armature.

17. The relay of claim 16 wherein the electromagnet system further comprises a coil body, the coil body comprising a pocket for accommodating the short arm of the armature, the short arm of the armature being biased against the long core arm by an armature spring.

18. An electromagnetic relay comprising:

a plurality of switchover contact sets mounted to a base defining a base plane, the base further comprising a unitary molded honeycomb-type structure of upwardly extending insulating walls which define a plurality of guide channels as well as a plurality of plug channels, each of said switchover contact sets comprising a make contact mount and a break contact mount disposed parallel to one another and connected to the base, each make contact mount including a make contact disposed at a free end thereof, each break contact mount comprising a break contact disposed at a free end thereof, each make contact mount being connected to the base at one of the plug channels, each break contact mount being connected to the base at one of the plug channels, the make and break contact mounts of each switchover contact set being connected to the base in a spaced-apart and aligned relationship, each of said switchover contact sets further comprising a contact spring disposed between the make contact mount and break contact mount of said set and a spring mount, each spring comprising a first end comprising a movable contact disposed between its respective make contact and break contact, each contact spring further comprising a second end connected to the spring mount of said set, the relay further comprising an electromagnet system comprising an armature connected to the contact spring by a slide that is disposed parallel to the base plane, the slide further comprises a plurality of openings and each of said springs further comprising a hook-shaped actuating tab disposed at the free end thereof for engaging one of the openings of the slide, each of said springs further comprises broadened shoulders disposed adjacent to the actuating tab for the supporting the slide, the armature being L-shaped and comprising a long arm and a short arm, the short arm of the armature being is mounted for pivotal contact against the long core arm, the long arm of the armature being connected to the slide, the electromagnet system further comprising a coil with an axis that extends perpendicular to the base plane, the electromagnet system further comprising an L-shaped core comprising a long core arm and a short yoke arm, the long core arm extending through the coil and perpendicularly away from the base plane, the short yoke arm comprises a pole segment that is bent parallel to the coil axis, the pole segment forming an operational air gap with the long arm of the armature, the electromagnet system further comprises a coil body, the coil body comprising a pocket for accommodating the short arm of the armature, the short arm of the armature being biased against the long core arm by an armature spring, each spring mount comprising a terminal segment connected to the base and a U-shaped connection segment comprising a first leg connected to the terminal segment and a second leg connected to the second end of its respective spring, each terminal segment being disposed parallel to, in alignment with, but spaced apart from its respective make contact mount, break contact mount and second end of its respective spring with its respective make contact mount disposed between said terminal segment and the second end of its respective spring, each U-shaped connection segment further being accommodated in one of the guide channels of the base and extending around its respective make contact mount, each contact spring extending from its respective guide channel and perpendicular to the base plane to the slide which is disposed opposite the base, each plug channel being insulated from each guide channel and from one another.

* * * * *